US007950602B2

(12) United States Patent
Petri

(10) Patent No.: US 7,950,602 B2
(45) Date of Patent: May 31, 2011

(54) DEVICE AND METHOD FOR MOVING REELS IN AN UNWINDER

(75) Inventor: Stefano Petri, Capannori (IT)

(73) Assignee: Futura S.p.A., Badia a Cantignano (IT)

( * ) Notice: Subject to any disclaimer, the term of this patent is extended or adjusted under 35 U.S.C. 154(b) by 0 days.

(21) Appl. No.: 12/280,843

(22) PCT Filed: Dec. 29, 2006

(86) PCT No.: PCT/IT2006/000886

§ 371 (c)(1),
(2), (4) Date: Aug. 27, 2008

(87) PCT Pub. No.: WO2007/099570

PCT Pub. Date: Sep. 7, 2007

(65) Prior Publication Data

US 2009/0065626 A1 Mar. 12, 2009

(30) Foreign Application Priority Data

Mar. 3, 2006 (IT) ..... FI2006A0061

(51) Int. Cl.
*B65H 19/10* (2006.01)

(52) U.S. Cl. ..... 242/559

(58) Field of Classification Search ..... 242/558, 242/561, 563, 563.2, 559, 559.1, 559.3, 559.4, 242/533, 542.3, 541.5, 541.6, 541.7
See application file for complete search history.

(56) References Cited

U.S. PATENT DOCUMENTS

| | | | | | |
|---|---|---|---|---|---|
| RE13,672 | E | * | 1/1914 | Pfister | 242/422.4 |
| 1,569,650 | A | * | 1/1926 | Coldwell | 242/421.3 |
| 1,591,597 | A | * | 7/1926 | Williamson | 242/555.3 |
| 1,908,121 | A | * | 5/1933 | Crafts | 242/421.5 |
| 1,949,238 | A | * | 2/1934 | Broadmeyer | 242/559 |
| 2,929,572 | A | * | 3/1960 | Baumgartner et al. | 242/422.2 |
| 3,022,022 | A | * | 2/1962 | Freeman | 242/422.9 |
| 4,173,314 | A | * | 11/1979 | Curran et al. | 242/420.3 |
| RE31,192 | E | * | 3/1983 | Andreasson | 242/554.5 |
| 4,519,595 | A | | 5/1985 | Adachi | |
| 4,564,150 | A | * | 1/1986 | Keene et al. | 242/422.7 |
| 6,679,451 | B1 | * | 1/2004 | Biagiotti | 242/559 |
| 6,820,837 | B2 | * | 11/2004 | Long | 242/554.2 |

FOREIGN PATENT DOCUMENTS

| | | |
|---|---|---|
| GB | 16598 | 0/1913 |
| WO | WO 96/33120 | 10/1996 |
| WO | WO 2004/043827 | 5/2004 |
| WO | WO 2004/080867 | 9/2004 |
| WO | WO 2004/080869 | 9/2004 |

* cited by examiner

*Primary Examiner* — William A Rivera

(74) *Attorney, Agent, or Firm* — McGlew and Tuttle, P.C.

(57) ABSTRACT

Device for moving paper reels in an unwinder of the type in which a nearly empty reel (1) is moved along a predetermined path between more operating stations in each of which the reel (1) is free to rotate about its longitudinal axis. The device is disposed and acting between the said operating stations and comprises: a carriage (4) intended to support a nearly empty reel (1) and movable between said operating stations, the reel (1) being free to rotate about its longitudinal axis on the carriage (4); a structure (5) supporting said carriage (4); means for moving said carriage (4) between said operating stations; means for controlling said means for moving the carriage (4).

21 Claims, 10 Drawing Sheets

DEVICE AND METHOD FOR MOVING REELS IN AN UNWINDER

The present invention relates to a device and a method for moving reels in an unwinder.

It is known that unwinders are destined to unwind a web material from a reel to supply it to one or more machines located downstream in a determined work cycle.

In a possible known conformation, an unwinder comprises a bearing structure onto which two conical supports are disposed to engage two corresponding mandrels bilaterally inserted in the central tubular nucleus of the reel, also called "core", in such a way that the reel is free to turn about the respective axis and the free unwinding of the respective web is allowed.

An essential step during use of unwinders is the changing of the reel, that is an operation allowing replacement of a nearly empty reel with a new one. Such operation, during which the continuity of the web supply to the machines located downstream must be ensured, is most frequently carried out in an almost exclusively manual way with both the reels being stopped. Practically, the first reel, which is nearly empty, is moved away from the support cones, between which an operator, with the aid of a mechanical lifter, subsequently fits a new reel to be unwound. WO 2004/080869, WO 2004/080867, WO 2004/043827, U.S. Pat. No. 6,679,451 and EP 822912 disclose examples of mechanical unwinders in which the human intervention is reduced. In general terms, during the reel changing step, there are problems concerning the control of the tension of the paper supplied by the reel nearly empty in order to prevent excessive slackening or, on the contrary, undesired tears.

The main aim of the present invention is to solve the above mentioned drawbacks.

This result has been achieved according to the invention thanks to the idea of actuating a device and a method having the features described in independent claims. Other features of the invention are the object to the dependent claims.

Thanks to the present invention, it is possible to move the reels of paper which are finishing (nearly empty) in a controlled way, imposing to the same, during the reel change, a translation and a rotation with operating speeds apt to always assure an optimal control of the tension of the paper directed downstream. These features determines a reel changing which is more simple, more effective, more sure and also automatically operable. Moreover, a device in compliance with the present invention is of relatively simple and economic fabrication and reliable also after prolonged periods of use.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1:
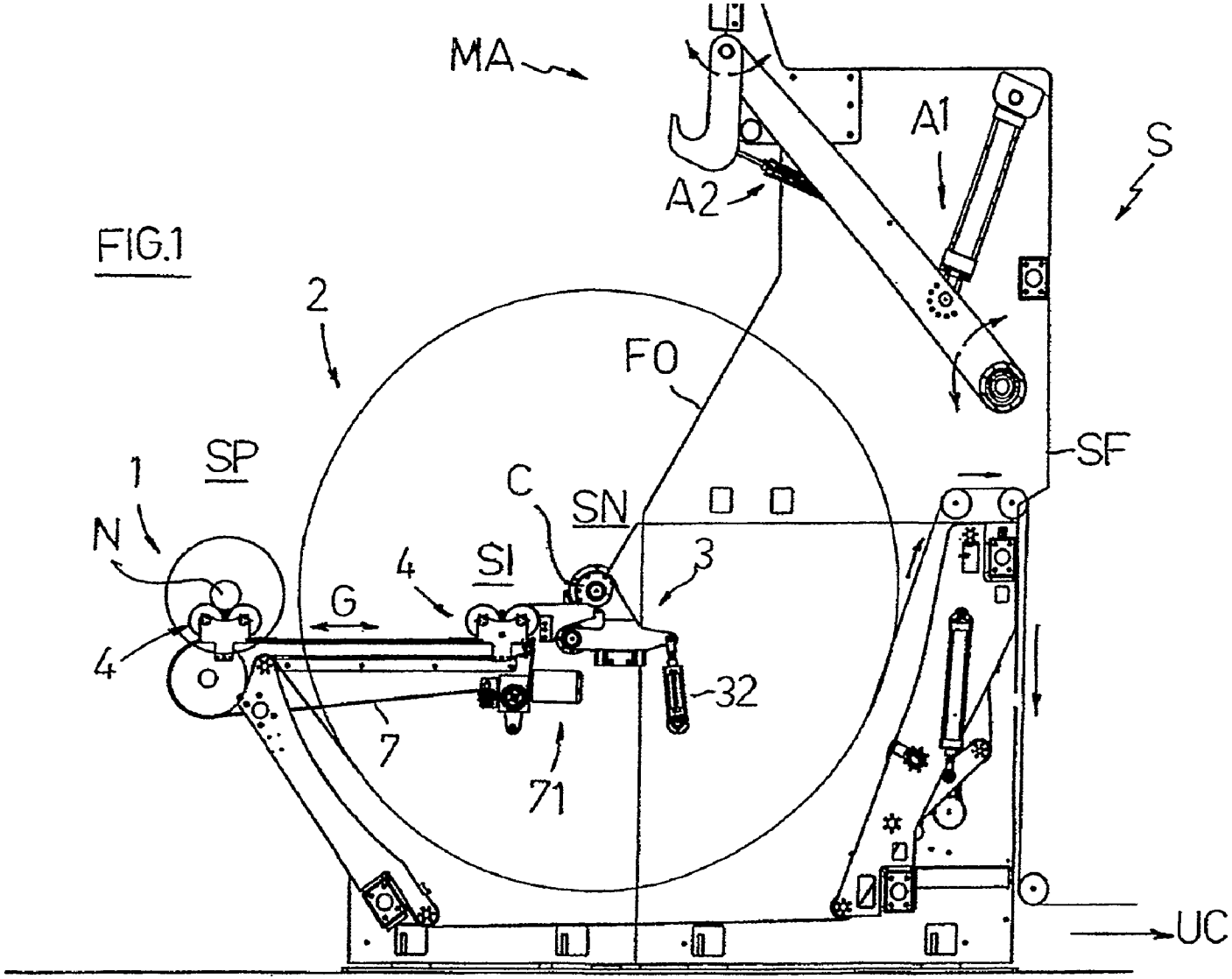
FIG. 1 represents a schematic side view of an unwinder provided with a device in accordance with a first embodiment of the present invention.

FIGS. 11A-11C schematically represent a sequence of disengagement of the cones from the mandrels applied on the core of a nearly empty reel in the station (SN).

Reduced to its essential structure and with reference to the example shown in the drawings of FIGS. 1-4, a device according to the present invention can be used in an unwinder of the type in which a reel nearly empty is transferred from a first station (SN) in which it rotates about its longitudinal axis until it is in a condition of "nearly total unwinding" (a condition in which its diameter reaches a predetermined value, smaller of the initial diameter) to a second station (SI) disposed at a predetermined distance from the first station (SN), and transferred again from said second station (SI) to a third station (SP) in which it can continue to rotate around its longitudinal axis until it is completely unwound, that is, until a new reel is placed in the first station (SN).

In the drawings, the references (1) and (2) designate, respectively, a nearly empty reel and a new reel destined to replace the nearly empty one; the reference (S) designates the unwinder.

The unwinder (S) has a supporting structure (SF) with an operating front (FO) on which there are defined, in correspondence of said first station (SN), support seats (AP) for the two axial ends of a reel (2). Such ends are formed by two conical elements (C) which can be inserted, on opposite sides, in the core (N) of the reel, said conical elements being partially projecting from the two sides of the reel and allowing the idle rotation of the reel on said support seats. Said conical elements (C) are disengaged from the core (N) of the reel before commanding the transferring from the first station (SN) to the second station (SI).

The structure and the functioning of an unwinder are known to the technicians working in this field and, therefore, a more detailed description is omitted.

The moving device which is the object of the present invention is disposed and acting between the second station (SI) and the third station (SP) and it comprises:

- means (3) for transferring a nearly empty reel (1) from said first station (SN) to said second station (SI);
- a carriage (4) apt to support a nearly empty reel (1) and movable between said second station (SI) and said third station (SP);
- a structure (5) for supporting said carriage (4);
- means for moving said carriage (4) between said second station (SI) and said third station (SP);
- means for controlling said transferring means (3) and said carriage (4) moving means.

Figure 3:
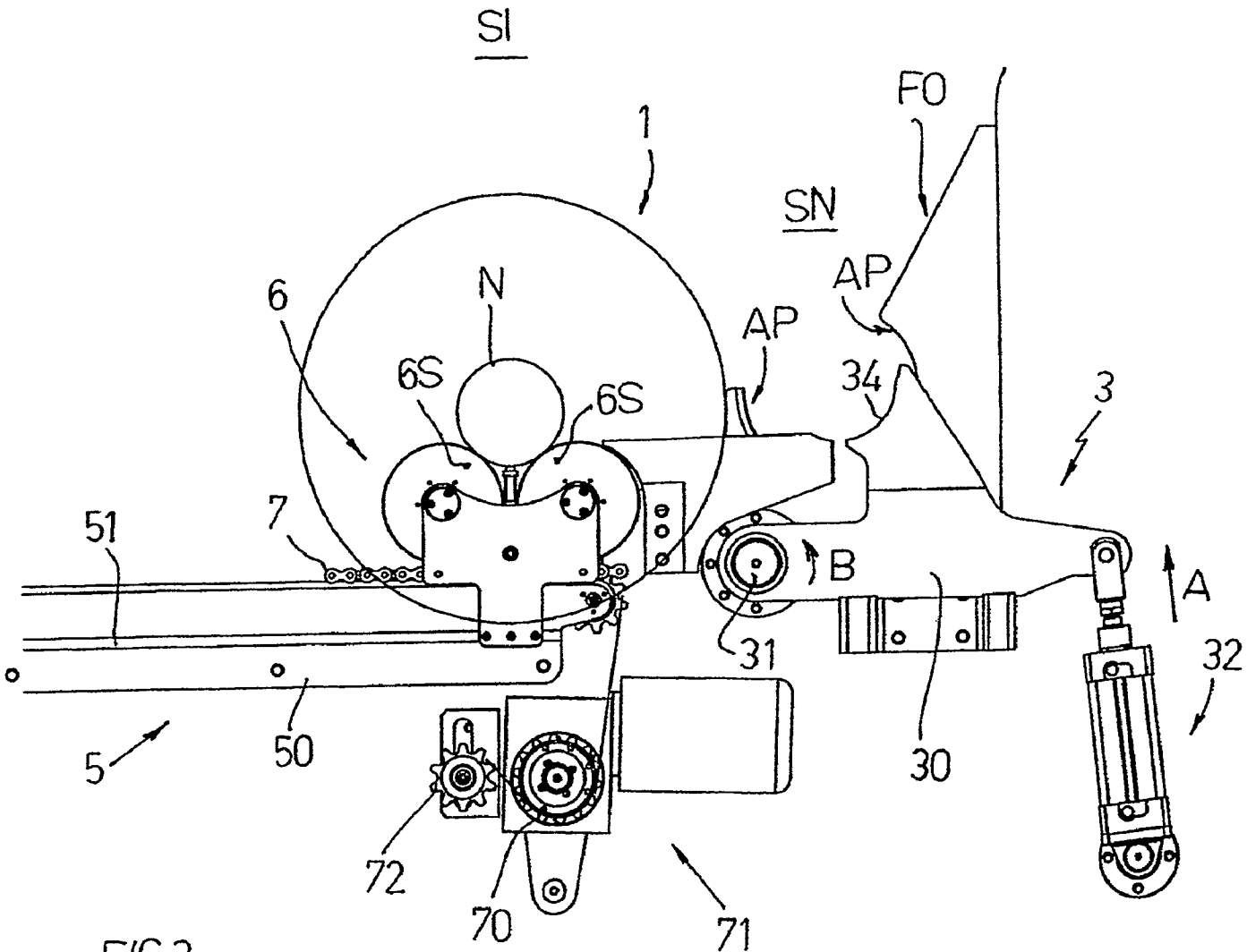
FIG. 3 represents a modified particular of the example of FIG. 2, wherein it is shown a nearly empty reel (1) supported by a device in compliance with the present invention.
Figure 4:
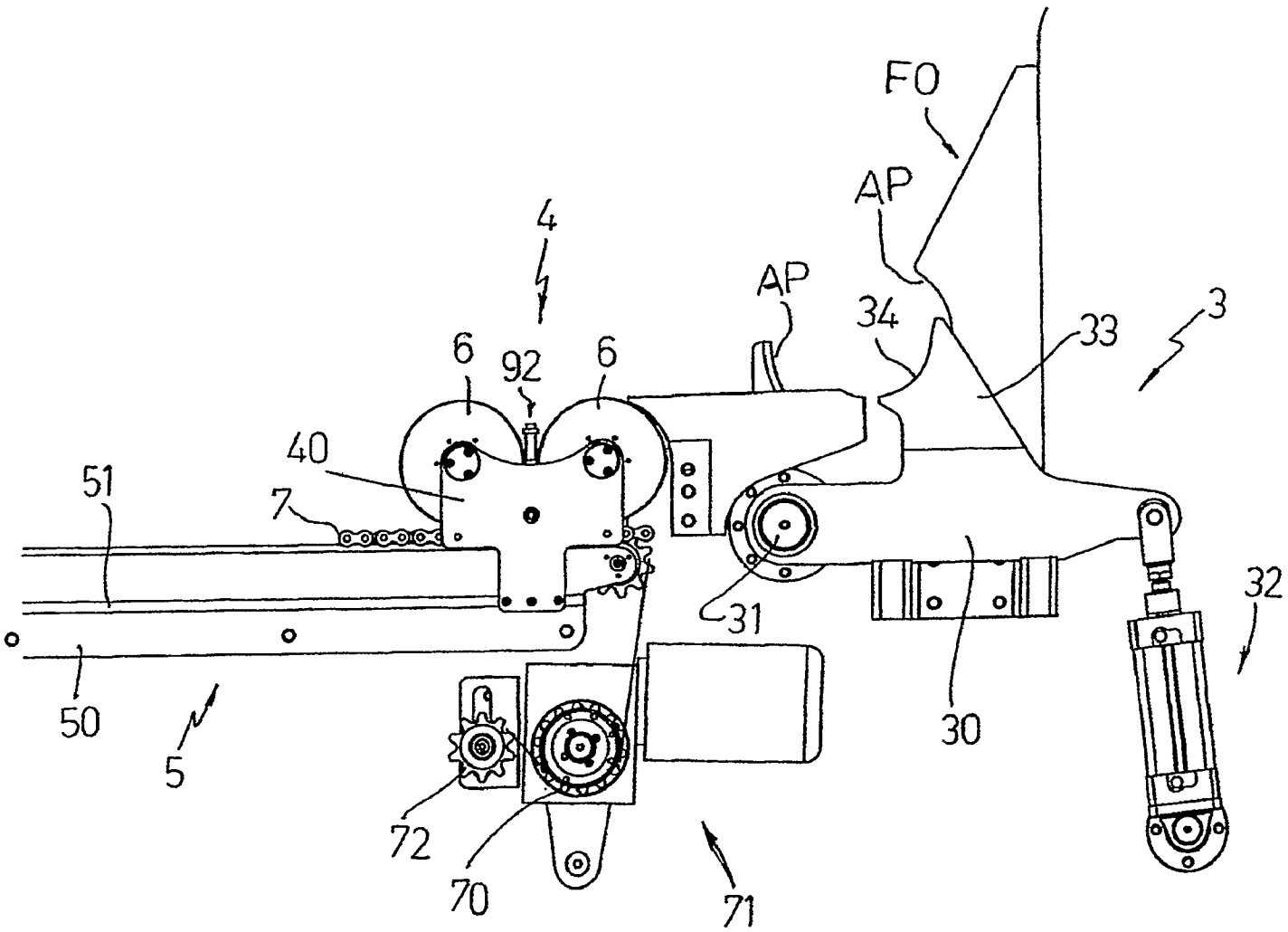
FIG. 4 is identical to FIG. 3, except for the fact that the reel (1) is not shown for a better representation of other parts of the drawing.

The means (3) which execute the transferring of the nearly empty reel (1) from the first station (SN) to the second station (SI) comprise, in compliance with the example shown in the annexed drawings, two pushers (30) destined to act on said conical elements (C) inserted in the core (N) of the reel disposed in first station (SN), that is on the two ends of the reel projecting from said seats (AP), in order to push the reel towards the second station (SI) and, more in particular, towards the carriage (4) which is disposed in stand-by condition. In the example, each of said two pushers (30) is formed by a lever hinged with one of its ends to a fixed part of the structure (SF), the axis of hinge (31) being parallel to the axis of the reel (1); the lever is connected, at the opposite end, to an actuator (32) which, when activated, determines the rotation of said lever about the axis of hinge (31). Said pushers are disposed externally to the support seats (AP). In the annexed drawings only one pusher is visible, since it is shown only a side of the device. Each of said pushers (30) has a central appendix (33) with a concave end (34) for a better engagement with the corresponding end of the reel (1). The arrow "A" represents the activation of the actuator (32), that is the extension of the respective rod, which corresponds to the rotation (counter-clockwise in the drawings) of the pusher (30) as represented by the arrow "B". The deactivation of actuator (32), that is the retraction of the relevant rod, involves the contrary rotation of the restoration of the pusher (30) and, therefore, the restoration of the normal stand-by or rest condition of this mechanism as shown in FIG. 3 and FIG. 4.

However, the particular mechanism utilized for transferring the reel (1) from the first station (SN) to the second station (SI) can be of any other type. Said carriage (4) is supported by a structure (5) developing between said second and the third station (SI, SP), that is upstream of the first station (SI) with respect to the direction (UC) of the paper exiting from the unwinder.

More particularly, said structure (5) is provided with two horizontal sides (50) developing mainly longitudinally, each of which having an external rectilinear track (51) acting, as further described below, as a guide element for the carriage (4). In the figures of the annexed designs, it is shown only one side (50) of the structure (5). In the example, said track (51) is horizontal.

Said carriage (4) comprises two forks (40), one for each of the two sides (50) of the structure (5). Each of said forks is provided, on its external side, with a lower "L"-shaped appendix (41) whose end slides in the track (51) of a corresponding side (50) of the structure (5). In this way, the carriage (4) is guided on the structure (5). In the figures of the annexed designs, it is visible only one of said forks (40).

Figure 5:
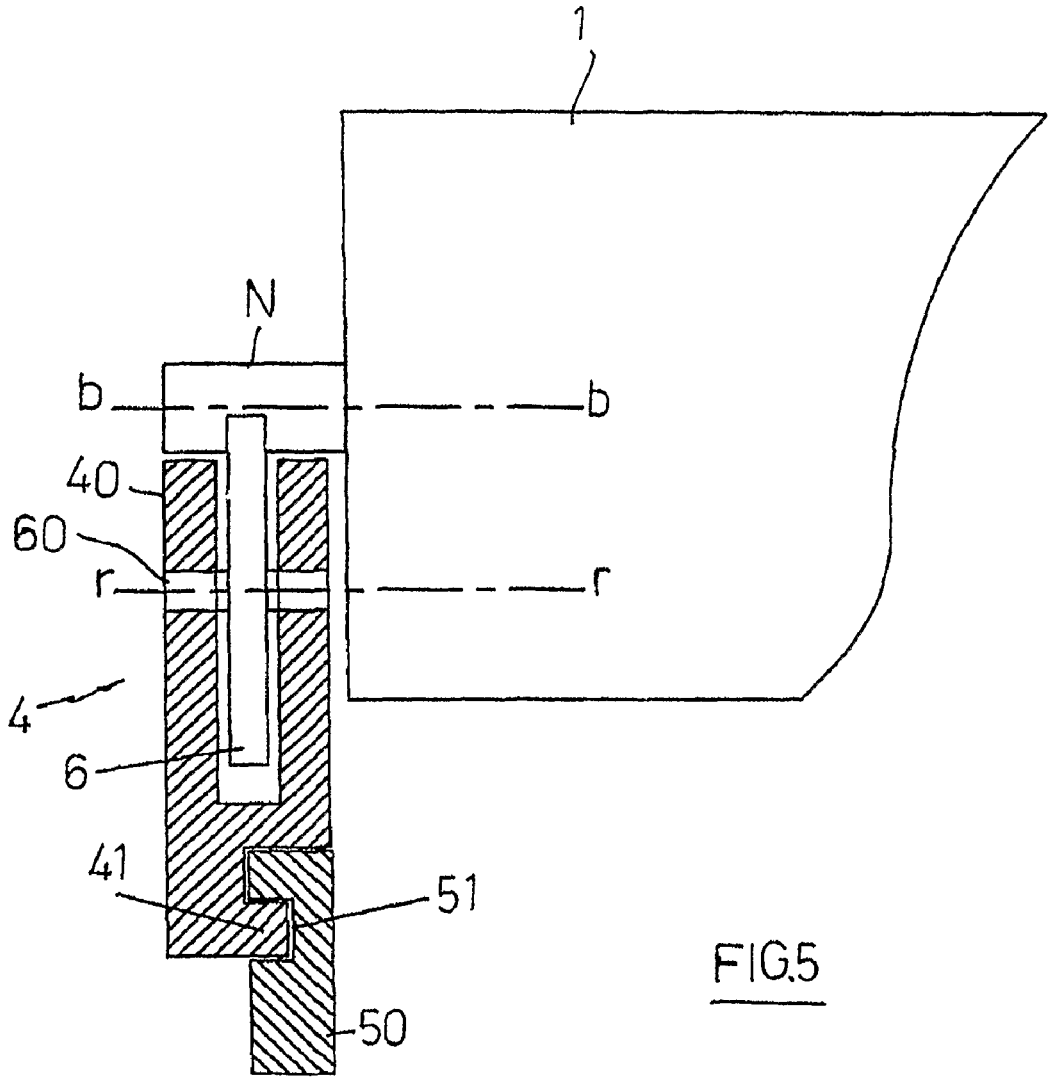
FIG. 5 represents a cross-sectional view in correspondence of one of two sides of the carriage, in which, for sake of simplicity, the transport chain of the carriage is not represented.

Each of said forks (40) supports two idle rubber wheels (6) having identical external diameter. The two wheels (6) are mounted with the respective axes (r-r) parallel to the longitudinal axis (b-b) of the reel (1), that is oriented orthogonally regarding the two arms of the respective fork (40). In the example, the mounting of the two wheels (6) on the fork (40) is realized by means of two corresponding pins (60) whose axes (r-r) are disposed on a same horizontal plane and whose distance is such that, given the external diameter of the wheels (6), a corresponding end of the core (N) projecting from the reel (1) can be supported on the wheels (6) free to rotate about its axis (b-b). In other words, as shown in FIG. 3 and FIG. 5, there is an in-line disposition of the two wheels (6) supported by each of the forks (40) and the distance between the axis of the two wheels is such that a surface portion of the end of the core (N) projecting from the reel (1) can be supported on the upper internal sectors (6S) of the wheels. In practice, the carriage (4) is a cradle supporting the nearly empty reel (1), said reel (1) being free to rotate about its longitudinal axis.

Said carriage (4) is moved along the support structure (5) by means of a mechanism comprising, for each of the two sides of the carriage, an annular chain (7) gearing with a toothed spool fixed on the output (70) of a motor reducer (71) and engaging a plurality of guide toothed spools (72). A portion of the chain is fixed on the inner side of a correspondent fork (40). In practice, the movement of the chain (7) driven by the motor reducer (71) determines the movement of the carriage (4).

Figure 2:
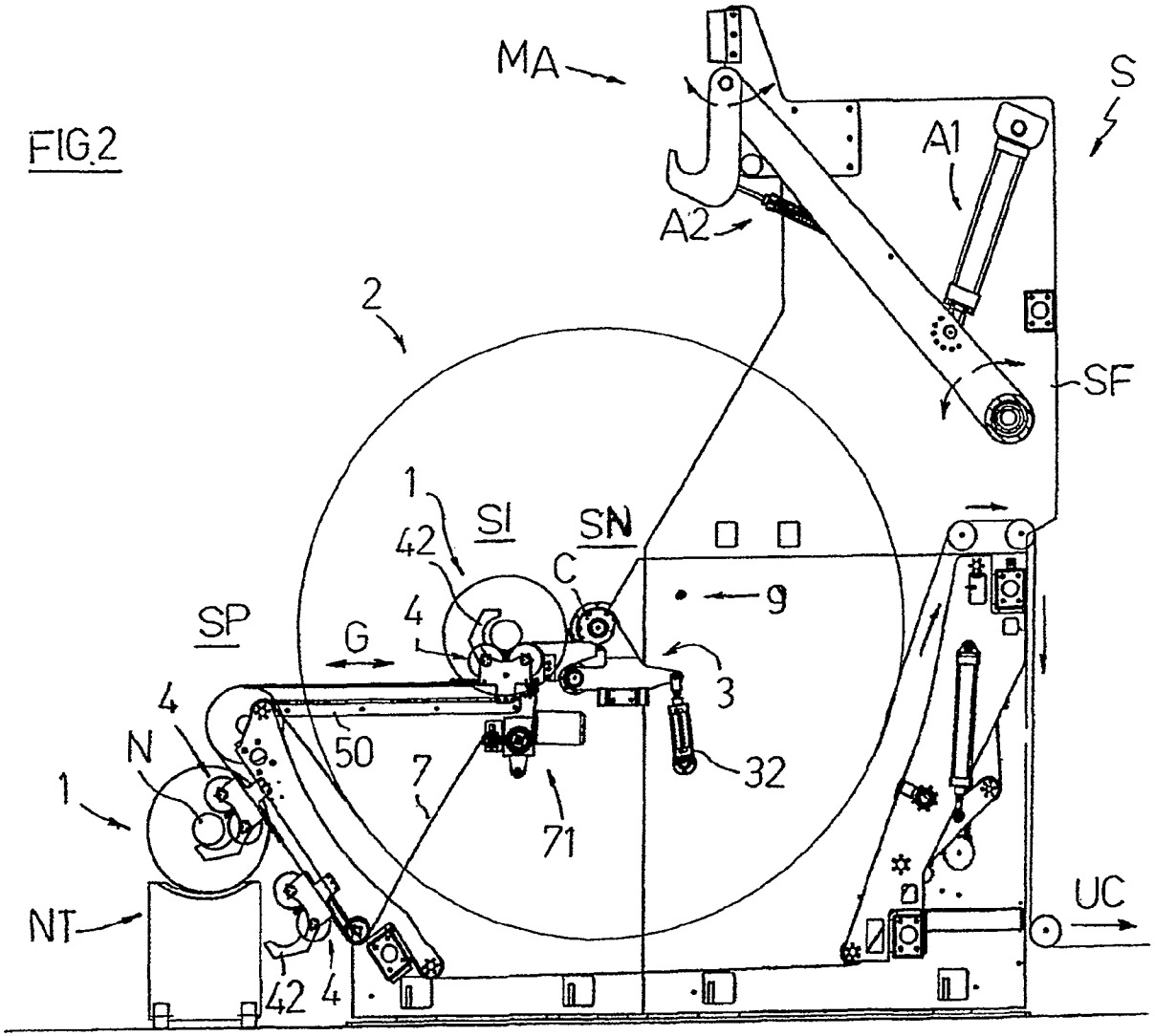
FIG. 2 represents a schematic lateral view of an unwinder provided with a device in accordance with a second embodiment of the present invention.
Figure 9:
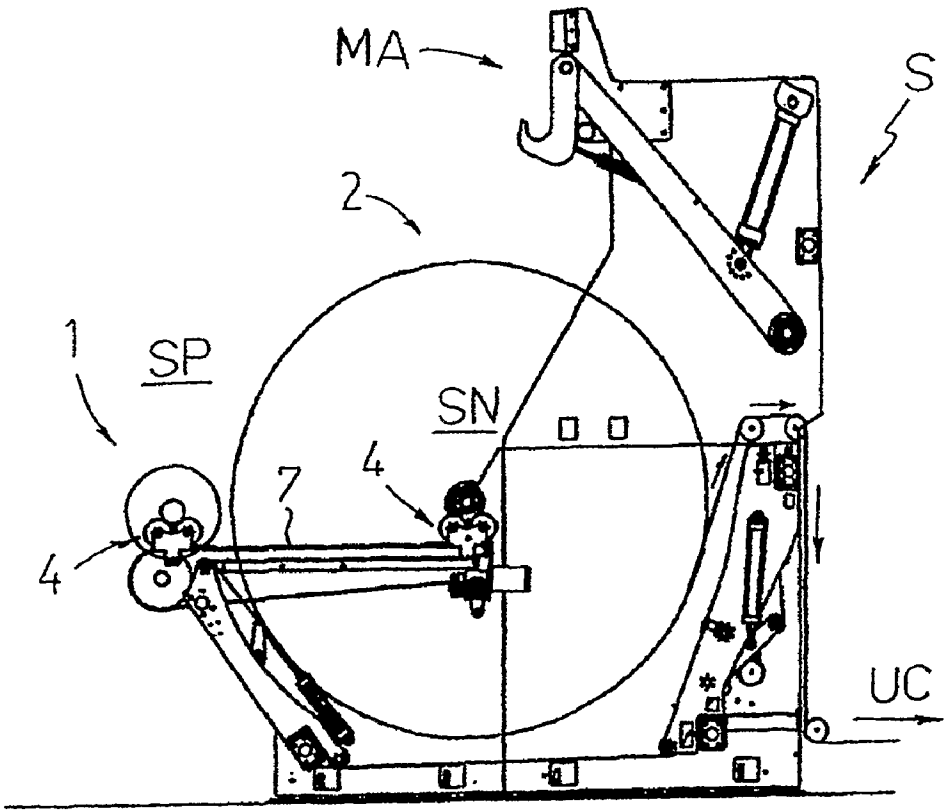
FIG. 9 represents a schematic side view of a re-winder provided with a device in compliance with the present invention, according to another embodiment of the same.

In the drawings, particularly in the schemes of FIG. 1, FIG. 2 and FIG. 9, the carriage (4) is represented in a plurality of operating positions, that is in the station (SI), in the station (SP) and in the station (SN).

The chain (7) is bi-directionally driven by the motor reducer (71), moving the carriage (4) alternatively between the stations (SI) and (SP), as indicated by the double arrow (G).

The carriage (4) is provided, on each of its sides, with a brake destined to act on the wheels (6), and, therefore, to slow down the rotation of the reel (1) about its axis (b-b), as further described below.

Figure 6:
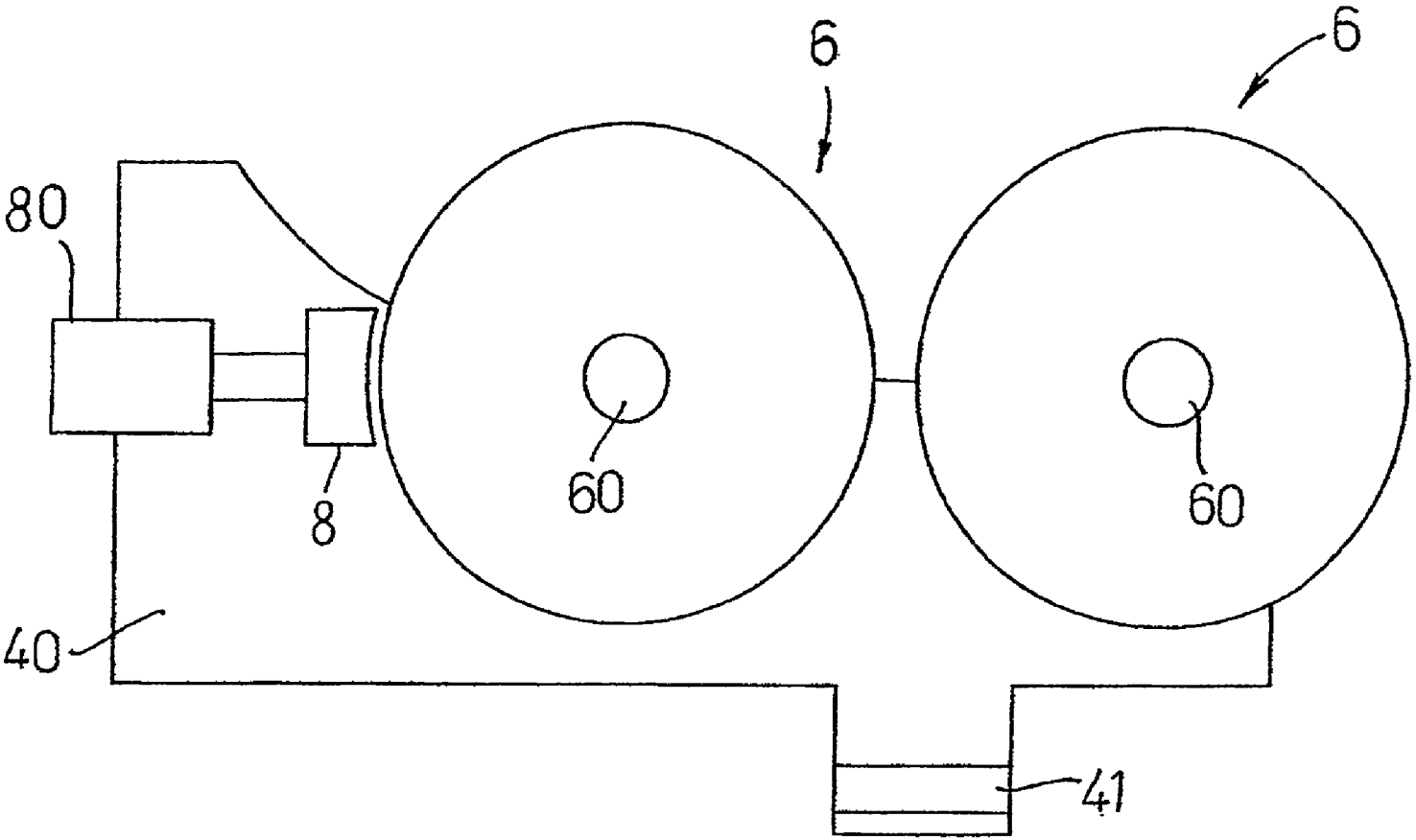
FIG. 6 represents a scheme relevant to the braking mechanism acting on the support and moving carriage of the reel nearly empty.
Figure 7:
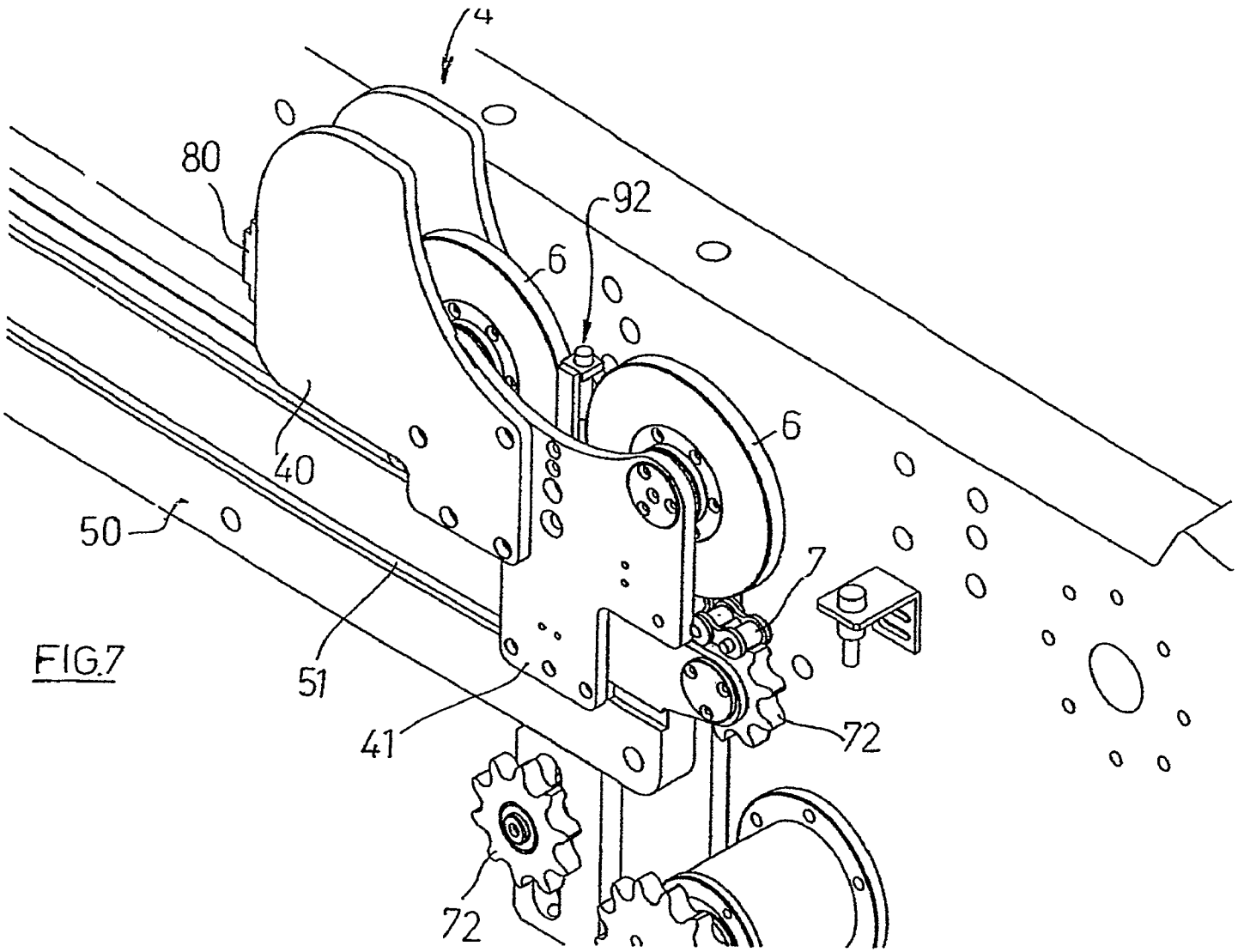
FIG. 7 represents a schematic perspective view in correspondence of one of two sides of the carriage.

In the examples given in FIG. 6 and FIG. 7, said brake is made of a body (8) with a concave front surface connected to a linear actuator (80) which, in turn, is fixed on the inner face of one of the two forks of the correspondent side of the carriage (4), so that the body (8) is behind one of the wheels (6). In the example, the brake is disposed behind the posterior wheel (6) of the couple of wheels, with the actuator being horizontally oriented. The contact between said body (8) and the wheel (6), determined by the activation of actuator (80), involves the braking of the wheel and, therefore, of the reel (1) whose core (N) is supported by the wheels (6) of the carriage (4) as previously said.

In the example represented in FIG. 2, the carriage (4) has, in correspondence of each of its sides, a lateral appendix (42) having a concave side turned towards the top and towards the wheels (6). The function of said appendix (42) is described below.

A possible operating cycle of the device, reference being made to the scheme of FIG. 1, is the following.

Figure 8:
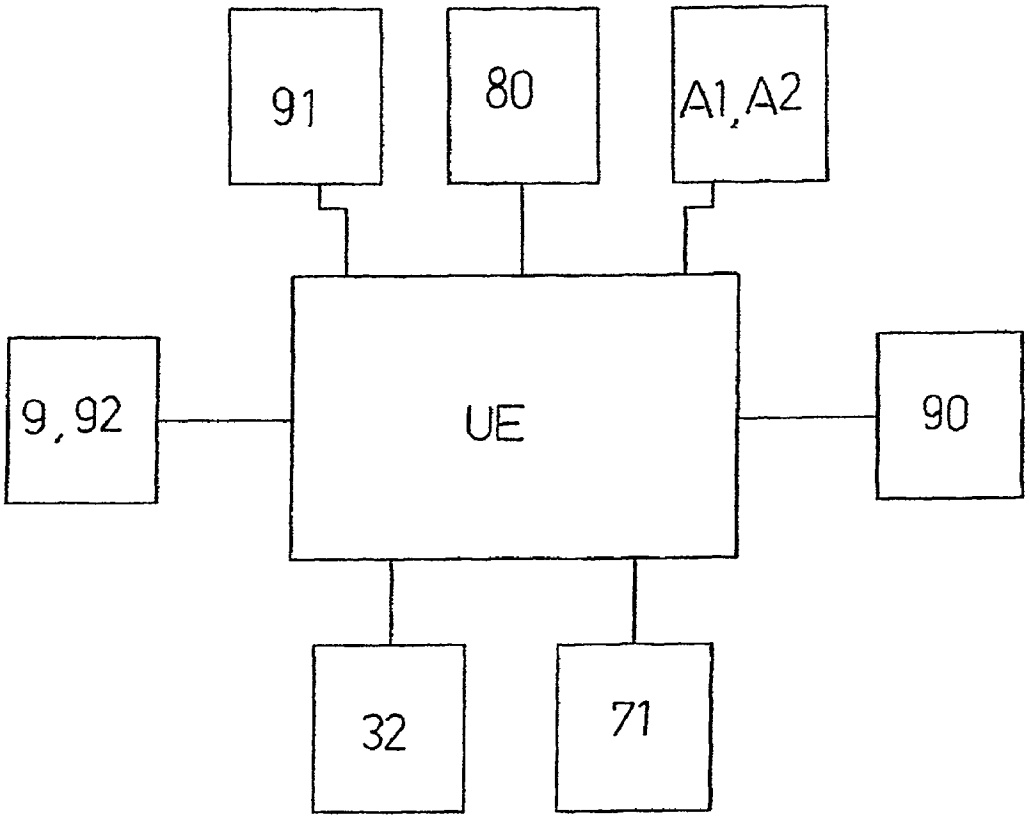
FIG. 8 represents a simplified diagram of the control and command system.

A photoelectric cell (9) controls the diameter of the reel (2) placed with the ends of its core on the support seats (AP) of the station (SN); when the photo-cell senses that the diameter of the reel has been reduced to a predetermined value, the same photo-cell emits a signal which is transmitted to a programmable control unit (UE)—structurally and functionally known by the technicians of the industrial automation—which commands the activation of actuator (32) and, therefore, the rotation (B) of lever (30). Therefore, the reel is transferred from the station (SN) to the station (SI) where the carriage (4) is disposed to receive the nearly empty reel (1). A photoelectric cell (90), visible only in the scheme of FIG. 8, senses the presence of the reel (1) on the carriage (4) and supplies, by means of the unit (UE), an assent signal for the activation of motor reducer (71) which, correspondingly driving the chain (7), moves the carriage (4) with a predetermined speed along the structure (5) until the carriage is disposed in the station (SP). Meantime, the reel (1) is free of rotating about its axis (b-b) and, therefore, it continues to supply paper to the machines disposed downstream of the unwinder (S); moreover, the unit (UE) commands the lowering of the mechanical arm (MA), activating the respective actuators (A1, A2), arm on which a new reel is already ready for replacing the one removed from the station (SN). The arm (MA) is known to the technicians working in this field. When the carriage (4) arrives to the station (SP), another photoelectric cell (91), represented in the scheme of FIG. 8, by means of the unit (UE) supplies an assent signal for the activation of actuator (80) and, therefore, for the braking of the wheels (6). In such a way, the rotational speed of the nearly empty reel (1)

is controlled. This determines a more precise and effective unwinding of the reel (1), without excessive slackening of the paper which could compromise the reel change operation.

The unwinder (S) comprises means, which can be of known type to the technicians of this field, intended to join the initial edge or head-edge of the paper supplied by the new reel (2) with the final edge or tail-edge of the paper supplied by the reel (1) disposed in the station (SP). The unwinder also comprises means, which can be of known type to the technicians of the field, intended to cut the tail-edge of the paper supplied by the reel (1) disposed in station (SP) once said union is executed. These operations are not described in detail since they can be done according to known techniques.

The exhausted reel (1) is then removed from the station (SP) with the aid of a bridge crane (not visible in the drawings) or any another equipment normally available in plants making use of unwinders. Finally, the carriage (4) is brought back in the station (SI) in order to be ready for another cycle.

With reference to the scheme of FIG. 2, the operating cycle of the present device differs only in that the carriage (4) is used also for delivering the exhausted reel (1) to a conveyor belt or similar means (NT) which removes the exhausted reels from the unwinder. More particularly, said conveyor (NT) is disposed upstream and lowered with respect to the structure (5) and it is oriented parallel to the axes of reels (1, 2). Moreover, the structure (5) is downwardly prolonged in its rear part, thus realizing a reentering portion which is inclined and downwardly oriented, so that the carriage (4) can pass over the conveyer (NT). When the carriage (4) with the reel (1) arrives in correspondence of the conveyer (NT), after having passed the station (SP), the reel (1) (whose core is supported by the appendixes 42 of the carriage) is intercepted by the conveyor belt which disengages it from the hooks constituted by said appendixes (42) while the carriage (4) moves downwardly. In FIG. 2 the carriage (4) is represented in the station (SN), in correspondence of the conveyor (NT) while it delivers the reel (1) to the conveyor, and in a lower and more remote position with respect to the conveyor, that is, unloaded. Therefore, a portion of the path followed by the carriage (4) is horizontal and a successive portion is diagonal or approximately vertical.

In the drawings, the reference (92) indicates a sensor destined to sense the presence of the reel, mounted on the carriage (4) between the two wheels (6).

Figure 10:
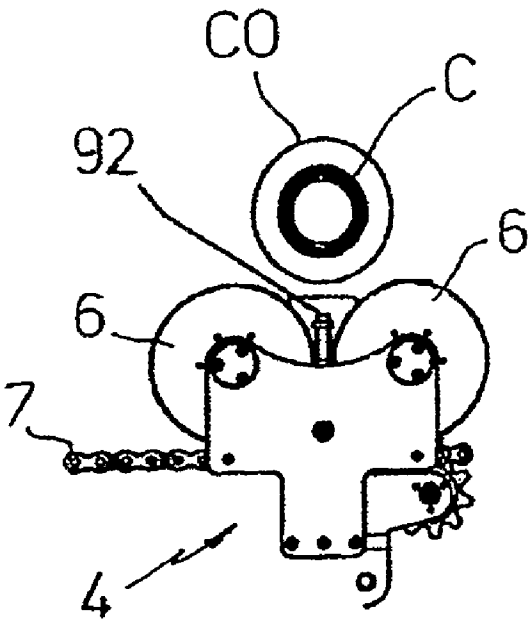
FIG. 10 represents an enlarged particular of FIG. 9, with some parts omitted to better show other parts.
Figure 11:
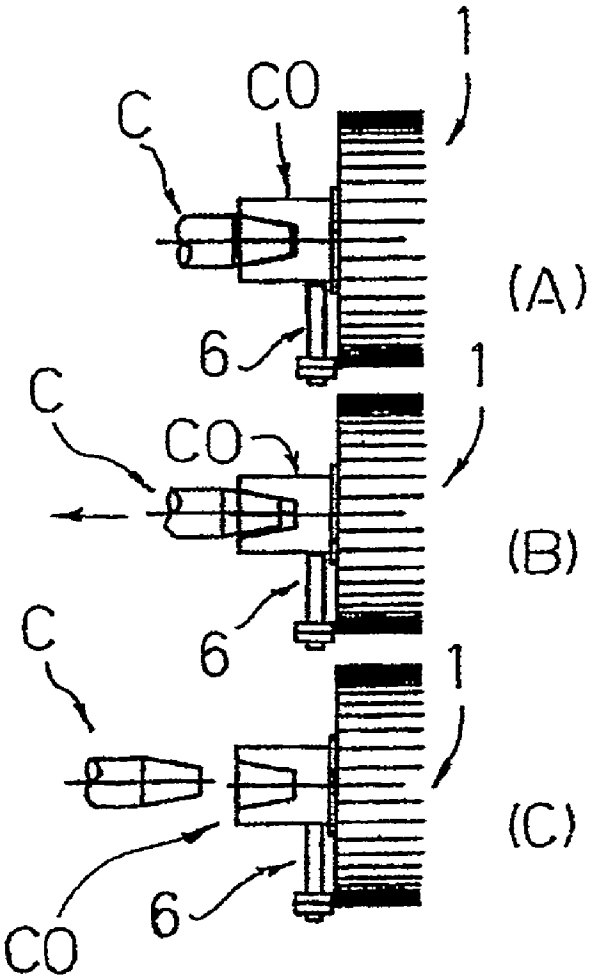

With reference to the example shown in the FIGS. 9 to 11 of the annexed drawings, a device in compliance with the present invention can be used in an unwinder of the type in which a nearly empty reel is transferred from a station (SN), in which the reel rotates about its longitudinal axis until the attainment of a condition of incipient exhaustion (condition in which the diameter of the reel reaches a predetermined value which is smaller than the initial value), to a station (SP) in which it can continue to rotate about its longitudinal axis until complete exhaustion, that is until a new reel is positioned in the first station (SN) replacing the nearly empty one. With respect to the example shown in FIG. 1—, there is a direct transfer of the nearly empty reel from the station (SN) to the station (SP): practically, there isn't the intermediate passage in the afore-mentioned station (SI) and the previously described transferring mechanism (3) is not required. More particularly, in the station (SN) the reel which is normally being unwound is supported by the cones (C) inserted in the mandrel (CO) of the two axial ends of the core (N), as visible in FIG. 11A. When the diameter of the reel is reduced to a pre-established value, as sensed by the above-mentioned sensor (9), the cones (c) are disengaged from the mandrels (CO), as schematically shown in FIG. 11B. Consequently, the reel (1), which is no longer supported by the cones (C), for gravity leans on the wheels (6) of the carriage (4) waiting below in stand-by position. At this point, the carriage (4), once sensed the reel (1) by means of the sensor (92), is carried to the station (SP), as previously described. In the meantime, the mechanical arm (MA) puts a new reel (2) in the station (SN). Once unloaded, the carriage (4) is returned back to its initial position, that is under the reel (2) in phase of normal unwinding. Regarding to this aspect, it is observed that the working position of the carriage (4) is such that the wheels (6) can freely pass under the mandrels (C) of the reel (2), without any interference, so the carriage (4) can be freely brought back in correspondence of the station (SN) even if in the same station a new reel (2) has been positioned.

The cones (C), with the relevant extraction/retraction mechanisms, that is engagement/disengagement of the mandrels (CO) on the axial ends of the reels, are supported by the structure of the unwinder (S) in correspondence of two sides of the same. The functioning and the structure of said cones (C) are known to the technicians working in this field and, therefore, it will be not described in detail.

As in other figures of the annexed drawings, in FIG. 9 the carriage (4) is represented in station (SN) ad also in station (SP).

An operating method in compliance with the present invention comprises, within a reel change cycle in an unwinder, a step of transferring a nearly empty reel (1) from a station (SN) in which the reel (1) rotates about its longitudinal axis until the attainment of a condition of incipient exhaustion (condition in which its diameter reaches a pre-established value, smaller of the initial diameter) to a station (SP) in which it can continue to rotate about its longitudinal axis until the complete unwinding, that is until a new reel is placed in the first station (SN) and replaces the nearly empty reel, said transferring being operated at a predetermined translation speed along a predetermined path.

Moreover, an operating method in compliance with the present invention comprises a step of controlling the rotational speed of said nearly empty reel (1) at the end of said transferring path.

Practically, an operating method in compliance with the present invention, comprises moving the nearly empty reel (1) along a pre-established path, with a controlled speed, said path developing between more operating stations of an unwinder. An operating method in compliance with the present invention comprises also a step of controlling the rotational speed of the reel (1), particularly in correspondence of the end-point of said transferring path.

With reference to the previously described examples, the transferring of the nearly empty reel (1) along the path comprised between the station (SN) and the station (SP) can be continuous or direct, or discontinuous with an intermediate transferring.

Practically, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

The invention claimed is:

1. A device for moving paper reels in an unwinder of the type in which a nearly empty reel is moved along a predetermined path between operating stations in each of which the reel is free to rotate about a longitudinal reel axis thereof, the device being disposed and acting between the operating stations, the device comprising:

a carriage for supporting a nearly empty reel, said carriage being mounted for movement such that said carriage is movable between one of said operating stations and another one of said operating stations, said carriage receiving said nearly empty reel at said one of said operating stations, said nearly empty reel being rotatable about said longitudinal reel axis on the carriage;

a structure supporting said carriage;

a means for moving said carriage between said operating stations; and a means for controlling said means for moving the carriage, wherein said carriage comprises a first side and a second side, each of said first side and said second side comprising a brake and two wheels, said brake acting on said at least one of said wheels when said carriage is at said another one of said operating stations such that said brakes slow down the rotation of said reel about said longitudinal reel axis from a first rotational speed to a second rotational speed, said first rotational speed being greater than said second rotational speed.

2. A device according to claim 1, wherein said path comprises said one of said operating stations and said another one of said operating stations, said reel rotating about said longitudinal reel axis until said reel has a predetermined diameter to form said nearly empty reel, said predetermined diameter being less than an initial diameter of said reel, said nearly empty reel rotating about said longitudinal reel axis at said another one of said operating stations until a new reel is placed in said one of said operation stations, said new reel replacing said nearly empty reel.

3. A device according to claim 1, wherein said path comprises said one of said operating stations, said another one of said operating stations and an intermediate station, said reel rotating about said longitudinal reel axis at said one of said operating stations until said reel has a predetermined diameter to form said nearly empty reel, said predetermined diameter being less than an initial diameter of said reel, said nearly empty reel being transferred from said one of said operating stations to said carriage when said carriage is in said intermediate station, said nearly empty reel rotating about said longitudinal reel axis until said nearly empty reel is exhausted.

4. A device according to claim 3, further comprising an automatic means for transferring said nearly empty reel from said one of said operating stations to said intermediate station, said intermediate station being placed at a beginning portion of said path.

5. A device according to claim 4, wherein said automatic means comprises two pushers, said one of said operating stations comprising support seats, each support seat supporting one axial end of said nearly empty reel, each of said pushers engaging one end of the nearly empty reel projecting from one of said support seats such that said pushers push the nearly empty reel in a direction of said intermediate station, said carriage being located at said intermediate station when said pushers engage said nearly empty reel.

6. A device according to claim 5, wherein each of said pushers comprises a lever, said lever having a first end and a second end, said first end being opposite said second end, said first end being pivotably mounted to a fixed part of a fixed structure of the unwinder, said lever having a pivoting axis, said pivoting axis being parallel to said longitudinal reel axis when said reel is located in said one of said operating stations, said second end being connected to an actuator, said actuator moving said lever such that said lever rotates about said pivoting axis.

7. A device according to claim 1, wherein said structure has two horizontal sides, each of said two horizontal sides comprising an external rectilinear track defining a guide element for the carriage.

8. A device according to claim 7, wherein said external rectilinear track extends in a horizontal direction.

9. A device according to claim 1, wherein said carriage comprises two lateral forks, said nearly empty reel comprising a paper web, said nearly empty reel rotating about said longitudinal reel axis such that said paper web is supplied to the unwinder as said carriage moves from said one of said operating stations to said another one of said operating stations, said brake on said first side and said brake on said second side being movable in a direction of said two wheels and in a direction opposite said direction of said two wheels, wherein each said brake is movable when said carriage moves from said one of said operating stations to said another one of said operating stations, wherein said brake on said first side and said brake on said second side control a tension of said paper web to the unwinder when said carriage transfers said nearly empty reel from said first station to said second station.

10. A device according to claim 9, wherein each of said forks comprises, on an external side, a lower "L"-shaped appendix, one end of said appendix sliding in a track of a corresponding side of the structure when said carriage moves from said one of said operating stations to said another one of said operating stations.

11. A device according to claim 9, wherein each of said forks supports said two wheels.

12. A device according to claim 11, wherein each of said two wheels has a wheel axis, said wheel axis being parallel to said longitudinal reel axis, said wheel axis and said longitudinal reel axis being perpendicular to each of said forks.

13. A device according to claim 11, wherein said two wheels are mounted on the fork by means of two correspondents pins whose axes are disposed on a same horizontal plane, one of said two correspondent pins being located at a spaced location from another one of said two correspondent pins, said two wheels supporting one projecting end of said nearly empty reel such that said nearly empty reel is rotatable about said longitudinal reel axis.

14. A device according to claim 1, wherein said means for moving said carriage comprises, for each of said first side and said second side of the carriage, a chain connected to a motor-reducer and ring-closed on a plurality transmission spools.

15. A device according to claim 14, wherein said chain is activated bi-directionally by the motor-reducer such that said carriage moves alternatively between said one of said operating stations and said another one of said operating stations.

16. A device according to claim 1, wherein said braking means comprises a brake with a body with a concave frontal surface connected to a linear actuator, said linear actuator being fixed on the carriage, said body being disposed behind one of the wheels.

17. A device according to claim 1, wherein said carriage comprises a lateral appendix on said first side and said second side, said lateral appendix having a concave part.

18. An operating method executable during a change reel cycle in an unwinder, the method comprising the steps of:

providing a first station;

providing a second station;

providing a reel having an initial reel diameter;

providing a carriage, said carriage being mounted for movement such that said carriage is movable between said first station and said second station, said carriage comprising a first side and a second side, said first side and said second side comprising a brake and a plurality of wheels;

providing a new reel;

rotating said reel about a longitudinal reel axis thereof until said reel has a predetermined reel diameter to form a nearly empty reel, said predetermined reel diameter being less than said initial reel diameter;

transferring said nearly empty reel at a predetermined speed along a predefined path with said carriage from said first station to said second station;

placing said new reel in said first station after transferring said nearly empty reel from said first station to said second station;

controlling a rotational speed of said nearly empty reel by applying at least one of said brakes on one of said wheels after said nearly empty reel has been transferred to said second station such that said rotational speed of said nearly empty reel is decreased from a first rotational speed to a second rotational speed, said second rotational speed being less than said first rotational speed;

rotating said nearly empty reel about said longitudinal reel axis until said nearly empty reel is exhausted to define an exhausted reel after said new reel is disposed in said first station.

19. A method according to claim 18, wherein said nearly empty reel comprises a paper web, said nearly empty reel feeding said paper web to the unwinder as said carriage moves from said first station to said second station, said brake on said first side and said brake on said second side being movable in a direction of said plurality of wheels and in a direction opposite said direction of said plurality of wheels such that each said brake is movable when said carriage moves from said first station to said second station, wherein each said brake controls a tension of said paper web to the unwinder when said carriage moves said nearly empty reel from said first station to said second station.

20. A method according to claim 19, further comprising:

positioning the exhausted reel on a conveyer, said conveyer removing said exhausted reel from the unwinder, wherein said transferring step is operated in two successive steps, with a step of transferring said nearly empty reel from said first station to an intermediate station and a step of transferring from the intermediate station to said second station.

21. A method according to claim 20, wherein during the positioning of the exhausted reel on the conveyer, the exhausted reel is guided.

* * * * *